United States Patent [19]

Orals et al.

[11] 4,275,541

[45] Jun. 30, 1981

[54] FIRE RESISTANT FLOOR AND CEILING ASSEMBLY

[75] Inventors: David L. Orals, Arlington Heights, Ill.; Peter S. Bushey, Sharon, Wis.

[73] Assignee: United States Gypsum Company, Chicago, Ill.

[21] Appl. No.: 109,709

[22] Filed: Jan. 4, 1980

[51] Int. Cl.[3] ..... E04B 5/52

[52] U.S. Cl. ..... 52/483; 52/407; 52/481; 52/741; 411/387; 411/412; 411/417

[58] Field of Search ..... 52/407, 483, 410, 481, 52/479, 741; 85/1 L, 47

[56] References Cited

U.S. PATENT DOCUMENTS

| | | | |
|---|---|---|---|
| 2,292,557 | 8/1942 | Wilson | 85/41 |
| 3,090,164 | 5/1963 | Nelsson | 52/481 X |
| 3,309,826 | 3/1967 | Finn | 52/241 |
| 3,333,379 | 8/1967 | Harris | 52/483 X |
| 3,478,639 | 11/1969 | Gruca | 85/41 |
| 3,488,904 | 1/1970 | Schneller et al. | 52/241 |
| 3,740,912 | 6/1973 | Sauer et al. | 52/483 X |
| 3,861,269 | 1/1975 | Laverty | 85/46 |
| 3,943,680 | 3/1976 | Balinski | 52/481 |
| 3,977,142 | 8/1976 | Dove et al. | 52/363 |
| 4,018,132 | 4/1977 | Abe | 85/1 L |

*Primary Examiner*—Carl D. Friedman

*Attorney, Agent, or Firm*—Glenn W. Ohlson; Robert M. Didrick; Robert H. Robinson

[57] ABSTRACT

A fire resistant floor and ceiling assembly comprising in combination; a plywood layer; a gypsum floor underlayment extending adjacent below said plywood layer; a series of steel joists located below said underlayment and supporting the plywood and underlayment; a space-apart multiplicity of self-drilling self-tapping screws extending downwardly through the plywood and underlayment, and engaging said steel joists thereby attaching the plywood and underlayment to the steel joists, said screws having upper threads and lower threads with an interrupting non-threaded mid-portion therebetween, the non-threaded mid-portion extending a distance substantially the same as the thickness of said plywood layer; and, at least one layer of third generation fire resistant gypsum board connected to, and supported below, said steel joists by connecting means; whereby said assembly contains no combustibles in the plenum between said underlayment and fire resistant gypsum board, and whereby said assembly attains at least a one hour fire rating when exposed to a fire below said assembly.

A method of providing a fire resistant floor and ceiling assembly for steel joist construction.

17 Claims, 7 Drawing Figures

FIRE RESISTANT FLOOR AND CEILING ASSEMBLY

BACKGROUND OF THE INVENTION

1. Field of the Invention

The invention relates to a fire resistant floor and ceiling assembly and method of providing said assembly.

2. Description of the Prior Art

In multiple unit commercial and residential constructions it has been an acute need of the industry to provide a floor and ceiling assembly which attains a fire rating as well as providing necessary acoustical properties. Many fire resistant systems attain ratings while utilizing conventional wood joist or beam construction. Since wood beams pyrolyze, they provide resistance to flame spread, and due to the physical properties of the wood, also reduce heat transmission. However, with the wide preference for steel joist construction, heat transmission has become a problem and the existence of combustible materials between ceiling and floor constructions adds to the problem.

Some solutions have been offered utilizing laminated gypsum core boards. Additional solutions have been attempted utilizing wall construction applications wherein two spaced apart layers of panels are supported by channel shaped edgings which are screw attachable.

In attempting to fasten floor assemblies to steel joists, many fastener techniques have been studied. It has been a constant concern of the industry to properly affix multi-laminate assemblies to steel joists without screw tip burn-out or riding-up of one of the layers during installation. Conventional fastening devices utilize nails and screws having drywall screw threading with the ability to self-drill through various laminated surfaces.

While many fastening techniques have been explored, there is the basic problem always involved with respect to reduction of installation time and cost, while yet attaining fire resistancy and sound attenuation.

Plywood sub-floor construction is widely accepted. However, the utilization of this material allows for fire spread between building floors. Additionally the use of plywood does not sufficiently reduce sound transmission for use in constructions such as apartments, townhouses or other highrise construction.

It is an additional concern to make floor and ceiling constructions in as light a weight as possible to reduce construction costs and eliminate the need for large supporting members. The provision of various gypsum boards for sound attenuation and fire resistancy has also been attempted. It would be desirable to utilize relatively small joist members with a wide spacing for support of light weight assemblies. The reduction of material cost and installation time would correspondingly result.

OBJECTS OF THE INVENTION

Accordingly it is a primary object of the invention to provide a fire resistant floor and ceiling assembly which attains at least a one hour fire rating by removing combustible in the plenum between the floor and ceiling, reduce heat transmission through joist members, and protect upper plywood layers to ensure structural integrity upon exposure to a conflagration.

It is a major goal of the invention to provide such a fire resistant floor and ceiling assembly which also affords acoustical properties for use in multi-unit residential and commercial constructions.

It is an allied object of the invention to provide such an assembly which utilizes light weight elements thereby allowing wider spacing of joists with smaller size members.

It is accordingly a goal of the invention to utilize light weight gypsum laminates to replace present day plywood construction and thereby reduce both cost and weight.

It is an important object of the invention to permit proper affixation of multi-laminate floor constructions by utilization of self-drilling self-tapping screws which prevent riding-up of plywood layers without screw tip burn-out during penetration of steel joist members.

It is also a goal of the invention to utilize a dry gypsum floor underlayment which reduces installation time by avoiding the period of time with which wet gypsum concrete alternative materials must be allowed to set.

It is therefore a critical goal of the invention to provide such a fire resistant floor and ceiling assembly by replacing conventional wood joist constructions with steel joists while yet attaining at least one hour fire ratings.

SUMMARY OF THE INVENTION

All the aims objects and goals of the invention are attained by the provision of the fire resistant floor and ceiling assembly herein disclosed. The assembly comprises, in combination, a plywood layer and a gypsum floor underlayment extending adjacent below the plywood layer. A series of steel joists is utilized located below said underlayment and supporting the plywood and underlayment. Affixation of the plywood and underlayment of the joist is provided by means of a spaced-apart multiplicity of self-drilling self-tapping screws extending downwardly through the plywood and underlayment, and engaging said steel joists, thereby attaching the plywood and underlayment to the steel joists. The screws have upper threads and lower threads with an interrupting non-threaded mid-portion therebetween. The non-threaded mid-portion extends a distance substantially the same as the thickness of the plywood layer. Further, the assembly provides at least one layer of third generation fire resistant gypsum board connected to, and supported below, said steel joists by connecting means. The assembly thereby contains no combustibles in the plenum between said underlayment and fire resistant gypsum board, whereby said assembly attains at least a one hour fire rating when exposed to a fire below said assembly.

The objects of the invention are additionally obtained by a method of providing a fire resistant floor and ceiling assembly for steel joist constructions. The method comprises the steps of: placing a layer of gypsum floor underlayment atop the steel joists; placing a plywood layer over said underlayment; securing said plywood and underlayment layer to said joists by means of screw attachment utilizing self-drilling self-tapping screws having upper threads and lower threads with an interrupting non-threaded mid-portion therebetween. The non-threaded mid-portion extends a distance substantially the same as the thickness of the plywood layer. Said securing step additionally comprises driving said screws downwardly with the lower threads first penetrating the plywood layer then disengaging at the non-threaded mid-portion prior to the tip of the screw contacting the steel joists thereby preventing riding-up of the plywood and burning-out of the tip of the screw. Said step further comprising driving said screws to penetrate the steel joist with subsequent engagement of said upper threading with the plywood layer until the screw is fully driven with the head of the screw substantially flush with an upper surface of the plywood layer; and, affixing at least one layer of third generation fire resistant gypsum board below said steel joist.

DESCRIPTION OF THE PREFERRED EMBODIMENTS

The floor and ceiling assembly of this invention has particularly suitable application for steel joist framing of floors and flat roofs of townhouses, apartments, and similar multiple-unit edifices. The assembly is highly competitive with wood joist systems in price, ease of installation and quality. The novel system has a decided advantage over wood joists in all cases. The fire performance of steel joist assemblies has been an unknown factor, since only minimal testing and experimentation have heretofore been conducted. A particularly problematic feature of steel joists is that it is necessary to keep them from reaching their structural critical temperature. Since they do not possess built-in fire protection, the ceiling alone must keep the highly conductive metal from attaining a temperature sufficiently high enough to cause structural failure, viz., Underwriters Laboratories, Inc. "Unrestrained Criteria", having a maximum of 1100° F. average temperature. Wood joists form an insulative charcoal crust during combustion that protects the interior against rapid decomposition and load failure. It is therefore critical to keep the steel joists below these limits for one hour in order to obtain at least a one hour fire rating. Additionally, at a point during such intense heat created by a fire, or the like, intensified heat buildup in the plenum between the ceiling and sub-floor subjects any combustibles in the plenum to degradation at such temperatures.

With reference to the Figures, the floor and ceiling assembly of this invention is numerically referenced to the description herein, with like numerals corresponding.

Figure 1:
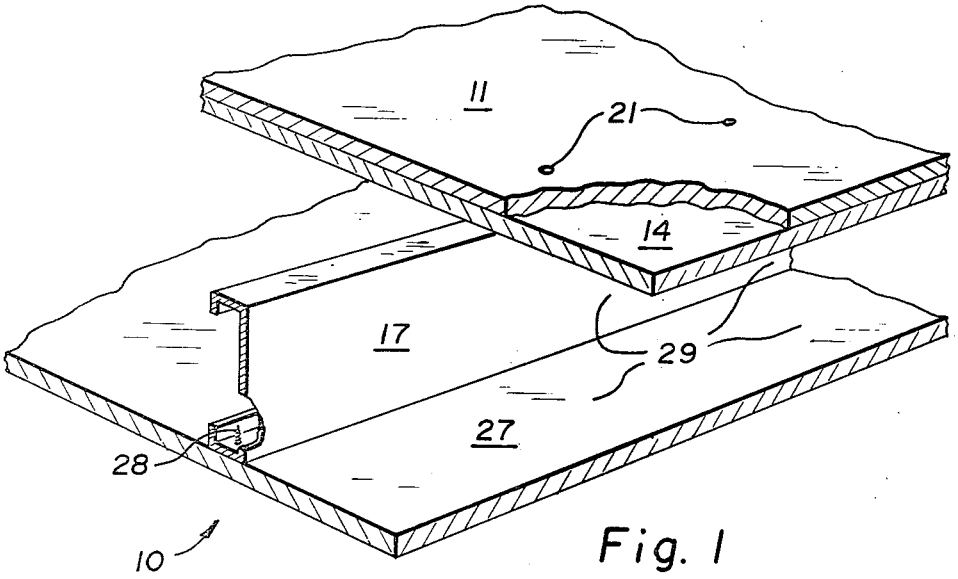
FIG. 1 is a perspective view of the preferred embodiment of the floor and ceiling assembly of this invention looking downwardly at a partially broken-away section thereof.

In obtaining at least a one hour fire rating, wherein ceiling layers do not fall off and the steel joist is prevented from reaching its critical temperature while combustibles are removed in the plenum between the ceiling and sub-flooring, FIG. 1 shows the preferred embodiment for the floor and ceiling assembly of this invention. In FIG. 1, floor and ceiling assembly 10 is shown in perspective view, partially broken away for illustative purposes. In solving the problems of the prior art with fire resistancy, while yet providing an acoustical construction, assembly 10 presents a desirable and excellent solution.

Conventional sub-flooring and flooring envisions the utilization of a plywood nailable layer. However, the use of multiple plywood layers provide a problem when considering increased weight. Additionally, plywood is combustible and heat transmission must be reduced thereto. Moreover, plywood has been found to be an unsatisfactory acoustical material. In previous attempts, a wet, or poured, gypsum concrete has been utilized for sound attenuation and heat insulation. The utilization of a wet gypsum concrete necessitates a drying time and an unfavorably high density of about 10 to 14 lbs. per square foot (with $\frac{3}{4}''$ thickness). With increased weights, larger structural members with closer spacings would be required. In further solution of these additional problems, assembly 10 utilizes a plywood layer 11 having a thickness in the range of from about $\frac{1}{4}''$ to about 1" with a preferable thickness of $\frac{5}{8}''$. In separating the plywood from the steel joists 17, a lightweight layer having heat and sound insulative properties is shown as gypsum floor underlayment 14. Underlayment 14 is a "dry" gypsum material having a weight of about 3.0 to about 5.0 lbs. per square foot when provided in a thickness of about $\frac{3}{4}''$. The material envisioned for utilizatin as underlayment 14 is PYROROCK Sound Underlament Board, manufactured by United States Gypsum Company. This material is a high-strength gypsum product for lightweight dry installation in sub-floor constructions. It is envisioned as being provided in a range of thicknesses from about $\frac{1}{2}''$ to about $\frac{3}{4}''$. Underlayment 14 extends adjacent below said plywood layer and rests atop a series of steel joists 17. It is important that secure affixation of plywood layer 11 and underlayement 14 be made to steel joist 17 in a facile manner. Therefore, self-drilling self-tapping screws 21 are provided for attachment of these layers to steel joists 17. In separating this plywood layer 11 and underlayment 14 from the ceiling below, steel joists 17 provide a separation, or plenum 29, therebetween.

Connected to, and supported below, steel joists 17, is at least one layer of fire resistant gypsum board 27. The material envisioned is known in the industry as third generation fire resistant gypsum board which utilizes a distribution of vermiculite therein for attainment of fire ratings of at least one hour. The terminology in the industry defines a first generation board as being a simple gypsum product and the second generation being the incorporation of glass fibers. The third generation board has provided not only the glass fibers but the inclusion of an unexpanded vermiculite distribution therethrough. This material helps insulate steel joist 17 and resists deformation during exposure to heat, and thereby remains affixed to steel joists 17 during such exposure. Self-drilling self-tapping screws 28 attach fire resistant gypsum board 27 to steel joist 17. The embodiment shown as assembly 10 in FIG. 1 provides at least a one hour fire rating when exposed to fire below fire resistant gypsum board 27.

Figure 2:
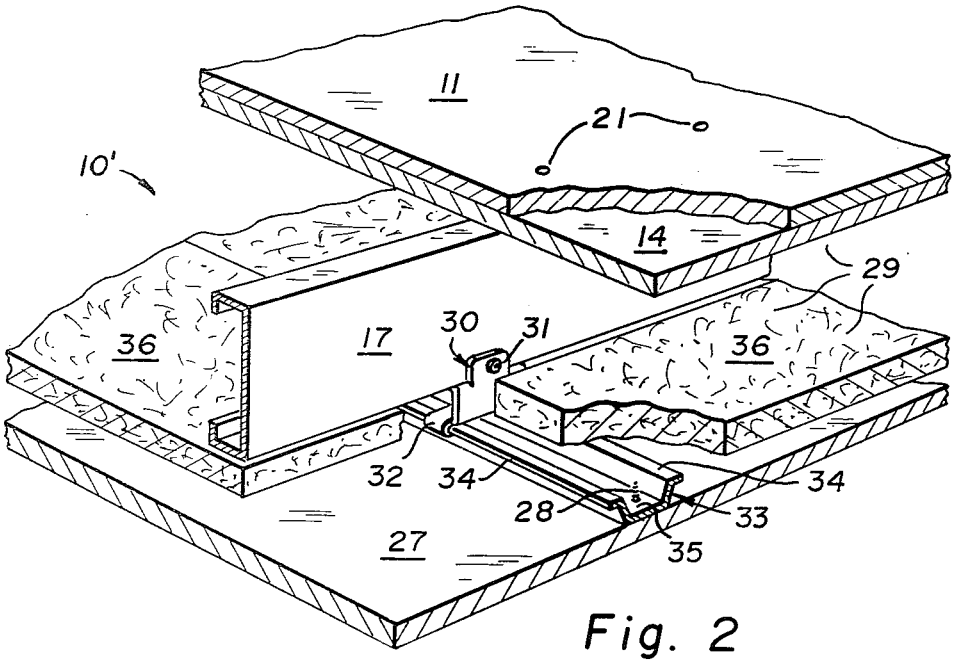
FIG. 2 is a perspective view of an alternate preferred embodiment for the floor and ceiling assembly of this invention looking downwardly at a partially broken-away section.

Within the scope of this invention, it is also envisioned that a floor and ceiling assembly be provided which can attain greater than a one hour fire rating and would desirably obtain at least a one and one-half hour fire rating. With reference to FIG. 2, assembly 10' is disclosed. Assembly 10' has, similar to assembly 10 of FIG. 1, plywood layer 11 atop a layer of gypsum floor underlayment 14. Screws 21 affix plywood layer 11 and underlayment 14 to joist 17. Assembly 10' provides further insulation for steel joist 17 and insulative separation of plywood layer 11 and underlayment 14. This additional insulative separation is provided by the utilization of a series of clips 30 having joist attachment means 31 and furring attachment means 32. Furring attachment means 32 connects furring strips 33 at clip engagable flanges 34 thereof. Furring strips 33 additionally have a support portion 35. Support portion 35 is screw engageable and is penetrated by screws 28 which pass through at least one layer of fire resistant gypsum board 27 for proper attachment. Assembly 10' additionally has an insulation layer 36 disposed atop clip engageable flanges 34 of furring strips 33 and extends below steel joists 17 for substantially the entire expanse of assembly 10'. Insulation layer 36 is preferably a mineral fiber material having a density of from about 2 lbs. per cubic foot to about 8 lbs. per cubic foot. Assembly 10' provides a construction whereby steel joists 17 are entirely separated from fire resistant gypsum board 27 by insulation layer 36 and furring strips 33. The only connection therebetween being clips 30 which are provided at spaced apart intervals conforming to normal furring strip spacing of from about 12" to about 24" center-to-center. Sound attenuation is additionally enhanced by such infrequent attachment and by insulation layer 36. In this alternate preferred embodiment, a one and one-half hour fire rating is provided.

Figure 3:
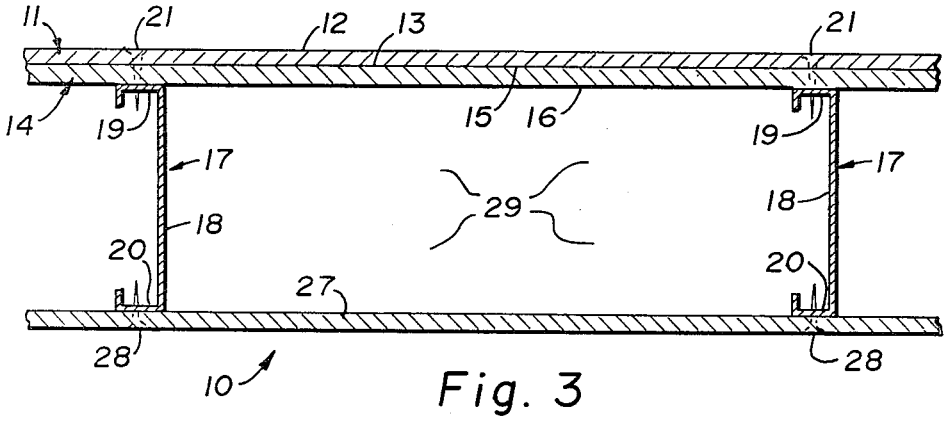
FIG. 3 is a cross-sectional view of the floor and ceiling assembly of this invention for the preferred embodiment as shown in FIG. 1.

With reference taken now to FIG. 3, a cross-sectional view of assembly 10, as shown in FIG. 1, is illustrated. Plywood layer 11 and gypsum floor underlayment 14 are separated by steel joist 17 from fire resistant gypsum board 27. In this preferred embodiment, steel joist 17 comprises a channel-shape having a vertical web 18 integrally interconnecting an upper flange 19 and lower flange 20 which reside in parallel spaced-apart relationship for attachments of said plywood layer 11, gypsum floor underlayment 14 and fire resistant gypsum board 27. Upper flanges 19 and lower flanges 20 provide screw-engageable surfaces for the respective attachment of self-drilling self-tapping screws 21 from above and self-drilling self-tapping screws 28 from below. Plenum 29 is shown as the chamber between the described layers for proper sound and heat insulation. Plywood layer 11 has an upper surface 12 and lower surface 13. Lower surface 13 rests adjacent atop underlayment 14 having an upper surface 15 in intimate contact with lower surface 13. Underlayment 14 additionally has lower surface 16 which rests atop upper flanges 19 of steel joists 17 in intimate adjacent contact.

Figure 4:
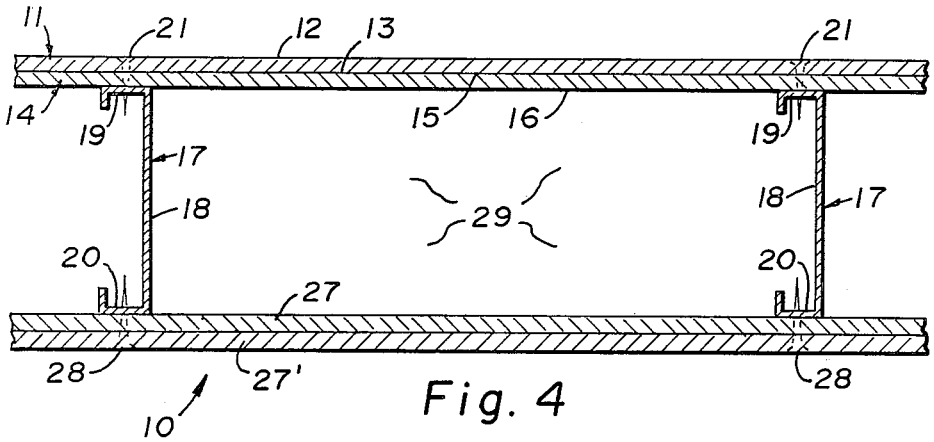
FIG. 4 is a cross-sectional view of the floor and ceiling assembly of this invention for the alternate preferred embodiment as shown in FIG. 2.

FIG. 4 shows an alternate construction for assembly 10, shown in FIGS. 1 and 3, wherein an additional layer of fire resistant gypsum board 27' is attached in intimate adjacent contact below the first layer of fire resistant gypsum board 27. In this configuration, a two hour fire rating is attained by the additional insulation provided by the double layer at the ceiling surface. Screws 28 are provided in sufficiently longer length for penetration of the fire resistant gypsum board 27 and 27' for proper affixation to lower flanges 20 of steel joists 17.

Throughout, steel joists 17, having the described channel shape, are envisioned as being provided in a height of about 4" to about 14", and a thickness in the range of from about 14 gauge to about 22 gauge. With the utilization of lightweight underlayment 14, and only a single layer of plywood 11, smaller joist sizes may be used and are preferrably provided in embodiments shown for assembly 10 and 10' as about 6" in height and about 18 gauge thickness. Within the ranges recited, conformance with particular building codes and structural requirements can be met while yet attaining the heat and sound insulative properties of this invention.

Figure 5:
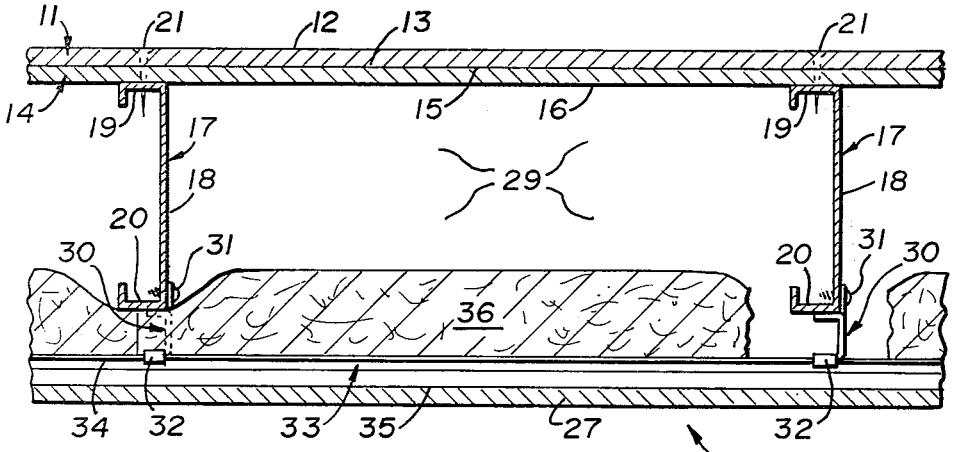
FIG. 5 is an additional alternate preferred embodiment similar to the embodiment shown in FIGS. 2 and 4 for the floor and ceiling assembly of this invention.
Figure 6:
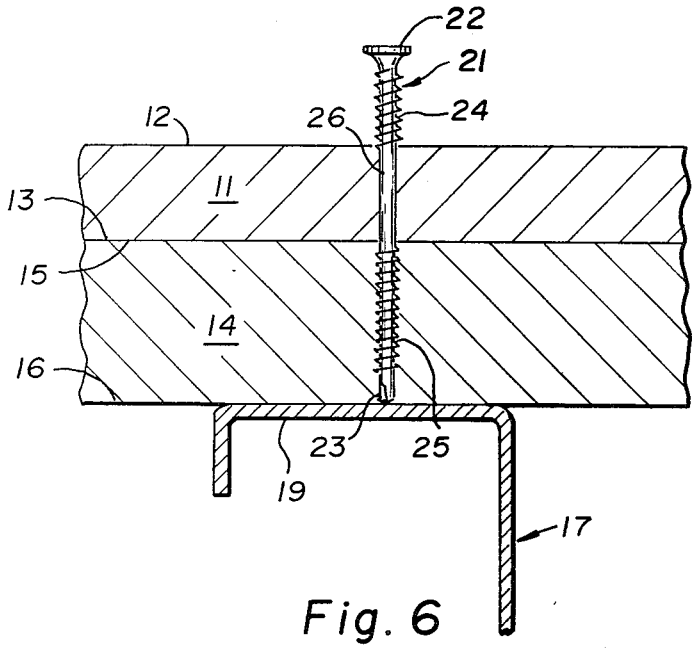
FIG. 6 is a cross-sectional view of a partial portion of the preferred embodiment of the floor and ceiling assembly of this invention showing affixation of the plywood layer and underlayment layer to a steel joist.

FIG. 5 shows a cross-sectional view of assembly 10', as shown in FIG. 2. Insulation layer 36 is shown as it extends below lower flanges 20 of steel joists 17 for attainment of the desirable separation and insulative qualities of the invention. Insulation layer 36 may be provided in a series of batts having a transverse dimension substantially the same as the center-to-center spacing of steel joists 17, being of about 16" to about 24". Clips 30 are shown attached to the web 18 of steel joist 17 at joist attachment means 31. At a lower portion of clips 30, furring attachment means 32 connect, transverse to steel joists 17, furring strips 33 at furring attachment means 32. Fire resistant gypsum board 27 is screw attached through support portion 35 of furring strip 33 by screws 28, as seen in FIG. 2. Thus, the further separation of fire resistant gypsum board 27 from steel joist 17 is provided for the attainment of a one and one-half hour fire rating. Additional sound attenuation properties are clearly attained, as would be apparent to one skilled in the art. Plenum 29 has substantially the same vertical demension in assembly 10' and in assembly 10, but its lower portion is additionally separated from fire resistant gypsum board 27 by the use of insulation layer 36, clips 30 and furring strips 33, as is apparent.

Particular concern in utilizing multiple-layer floor and sub-floor attachments is the problem of tip burn-out of self-drilling screws and the riding-up of upper layers of multiple layer construction. In this regard, and in solution thereof, self-drilling self-tapping screws 21 are provided for utilization in this invention, each having an overall length of from about 1" to about 2". Screws 21 are provided with a conventional head 22 which has a relatively flat upper profile and thus would extend flush with upper surface 12 of plywood layer 11 upon full engagement. At its opposite end, a drill tip 23 is provided in a conventional configuration for the penetration of steel members, such as steel joists 17. In preventing burn-out of drill tip 23, upper threading 24 and lower threading 25 are separated by an interrupting, nonthreaded, mid-portion 26. The upper threading 24 and lower threading 25 are provided in conventional drywall screw thread conformation. Upon initial engagement of the screw, lower threading 25 easily passes through plywood layer 11 and into underlayment 14. As drill tip 23 descends downwardly and contacts steel joist 17 at upper flange 19, lower threading 25 disengages plywood layer 11, thereby preventing drill tip burn-out and additionally resisting the riding-up of plywood layer 11, which would occur if the threading would be continuous. Upon penetration of upper flange 19 by drill tip 23, upper threading 24 begins to engage plywood layer 11. Therefore, the extent of mid-portion 26 is provided substantially the same as the thickness of plywood layer 11. Thereby, upper threading 24 only begins to engage plywood layer 11 upon penetration of upper flange 19 by drill tip 23 to afford solution to the noted problems.

Figure 7:
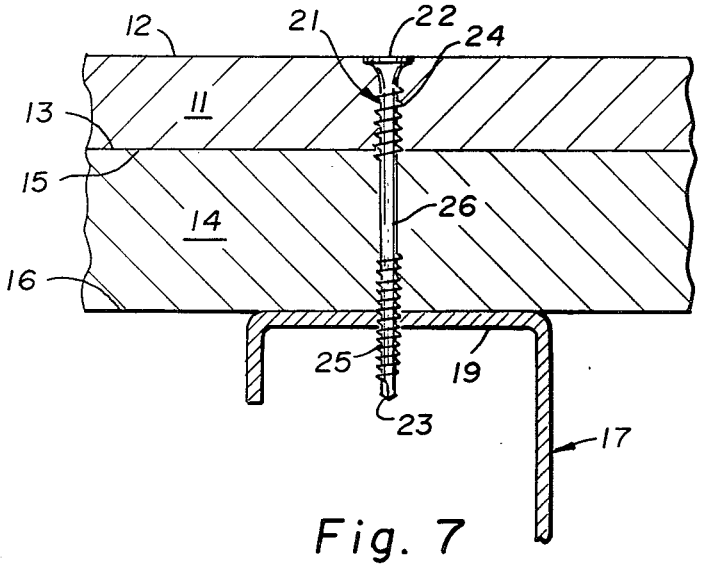
FIG. 7 is a partial section of the floor and ceiling assembly of this invention illustrating the complete affixation of the plywood layer and underlayment layer to a steel joist.

The fully attached position of plywood layer 11 and underlayment 14 to steel joist 17 is shown in FIG. 7. As illustrated, head 22 is substantially flush with upper surface 12 of plywood layer 11, thereby permitting flooring materials to be easily and properly installed thereon. Lower surface 13 of plywood layer 11 is shown in intimate planar contact with upper surface 15 of underlayment 14. Lower surface 16 of underlayment 14 is shown in intimate planar contact with upper flange 19 of steel joist 17. Thereby, a secure fully assembled level flooring is provided with proper attachment to steel joist 17 and elimination of drill tip burn-out and undesirable riding-up of plywood layer 11. Installation by these steps is simple and positive without the problems previously encountered in the industry. The utilization of plywood layer 11 and underlayment 14 additionally utilizes relatively light weight members for ease of handling during such installation procedures and cartage to the jobsite.

It is thus seen that all the aims, goals and objects of this invention are obtained by the disclosed assemblies 10 and 10', and alternatives, of the preferred embodiments of this invention. Moreover, the method of installing these assemblies, in accordance with the enunciated steps, satisfies further the objects recited and set forth herein.

What is claimed is:

1. A fire resistant floor and ceiling assembly comprising in combination:

a plywood layer;

a gypsum floor underlayment extending adjacent below said plywood layer;

a series of steel joists located below said underlayment and supporting the plywood and underlayment;

a spaced-apart multiplicity of self-drilling self-tapping screws extending downwardly through the plywood and underlayment and engaging said steel joists thereby attaching the plywood and underlayment to the steel joists, said screws having upper threads and lower threads with an interrupting non-threaded mid-portion therebetween, the non-threaded mid-portion extending a distance substantially the same as the thickness of said plywood layer; and at least one layer of third generation fire resistant gypsum board connected to, and supported below, said steel joists by connecting means;

whereby said assembly contains no combustibles in the plenum between said underlayment and fire resistant gypsum board; and, whereby said assembly attains at least one hour fire rating when exposed to a fire below said assembly.

2. A fire resistant floor and ceiling assembly as claimed in claim 1 wherein said plywood layer has a thickness of from about $\frac{1}{4}''$ to about 1".

3. A fire resistant floor and ceiling assembly as claimed in claim 1 wherein said gypsum floor underlayment has a thickness of from about $\frac{1}{2}''$ to about $\frac{3}{4}''$.

4. A fire resistant floor and ceiling assembly as claimed in claim 1 wherein said steel joists comprise channels having a generally C-shape wherein a vertical web interconnects two parallel spaced-apart arms.

5. A fire resistant floor and ceiling assembly as claimed in claim 4 wherein the height of the vertical web is from about 4" to about 14" and the joist has a thickness throughout in the range of from about 14 gauge to about 22 gauge.

6. A fire resistant floor and ceiling assembly as claimed in claim 4 wherein the joists are space-apart a distance of from about 12" to about 24" center-to-center.

7. A fire resistant floor and ceiling assembly as claimed in claim 1 wherein said fire resistant gypsum board has a thickness of from about $\frac{1}{2}''$ to about $\frac{3}{4}''$.

8. A fire resistant floor and ceiling assembly as claimed in claim 1 wherein said self-drilling self-tapping screws have conventional drywall screw threading and an overall length of from about 1" to about 2" whereby during installation the lower threading penetrates the plywood layer and disengages at the non-threaded mid-portion prior to contact with the steel joists thereby preventing riding-up the plywood and burning-out of the tip of the screw wherein said upper threading engages said plywood subsequent to penetration of the steel joist by the tip of the screw.

9. A fire resistant floor and ceiling assembly as claimed in claim 1 wherein one layer of fire resistant gypsum board is supportively connected to said steel joists by connecting means comprising self-drilling self-tapping screws extending through said layer and screw-engaging the joists.

10. A fire resistant floor and ceiling assembly as claimed in claim 1 wherein two layers of fire resistant gypsum board are supportively connected to said steel joists by connecting means comprising self-drilling self-tapping screws extending through said layers and screw-engaging the joists, whereby said assembly attains a two hour fire rating.

11. A fire resistant floor and ceiling assembly as claimed in claim 1 wherein one layer of fire resistant gypsum board is supportively connected to said steel joists by connecting means comprising;

space-apart clips engaged along said steel joists;

furring strips extending transverse to said joists and supportively engaged by said clips; and, self-drilling self-tapping screws extending through said layer of fire resistant gypsum board and screw-engaging a support surface of said furring strips;

whereby said layer of fire resistant gypsum board is separated from said joists by the connecting means to thereby reduce heat transmission to said joists upon exposure of said assembly to heat from below.

12. A fire resistant floor and ceiling assembly as claimed in claim 11 wherein a blanket of mineral fiber is disposed, and supported, atop said furring strips, and extends below said steel joists for substantially the entire assembly, thereby reducing heat transmission to said joists and whereby said assembly attains a one and one-half hour fire rating.

13. A fire resistant floor and ceiling assembly as claimed in claim 12 wherein said mineral fiber has a density of from about 2 lbs. per cubic foot to about 8 lbs. per cubic foot.

14. A method of providing a fire resistant floor and ceiling assembly for steel joist constructions wherein said method comprises the following steps:

A. placing a layer of gypsum floor underlayment atop said joists;

B. placing a plywood layer over said underlayment;

C. securing said plywood and underlayment layers to said joists by means of screw attachment utilizing self-drilling self-tapping screws having upper threads and lower threads with an interrupting non-threaded mid-portion therebetween, the non-threaded mid-portion extending a distance substantially the same as the thickness of the plywood layer, said securing step including driving said screws downwardly with the lower threads first penetrating the plywood layer then disengaging at the non-threaded mid-portion prior to the tip of the screw contacting the steel joists thereby preventing riding-up of the plywood and burning-out of the tip of the screw, and further including driving said screw to penetrate the steel joist with subsequent engagement of said upper threading with the plywood layer until the screw is fully driven with the head of the screw substantially flush with an upper surface of the plywood layer;

D. affixing at least one layer of third generation fire resistant gypsum board below said steel joists.

15. A method of providing a fire resistant floor and ceiling assembly as claimed in claim 14 wherein the step of affixing said fire resistant gypsum board comprises screw-attaching one layer of fire resistant gypsum board to said steel joists by driving self-drilling self-tapping screws upwardly through said board to engage said steel joists.

16. A method for providing a fire resistant floor and ceiling assembly as claimed in claim 14 wherein the step of affixing said fire resistant gypsum board comprises screw attaching two layers of fire resistant gypsum board to said steel joists by driving self-drilling self-tapping screws upwardly through said two layers to engage said steel joists.

17. A method of providing a fire resistant floor and ceiling assembly as claimed in claim 14 wherein the step of affixing at least one layer of fire resistant gypsum board comprises:

A. positioning and engaging clip means along said joists at space-apart intervals;

B. positioning furring members transverse to said joists and attaching said furring members to said clip means;

C. disposing a blanket of mineral fiber atop said furring members to extend below said joists for substantially the entire assembly; and, D. screw attaching at least one layer of fire resistant gypsum board to said furring members by means of driving self-drilling self-tapping screws upwardly through said fire resistant board to engage a support portion of said furring members.

* * * * *